US007927165B2

(12) United States Patent
Schlecht

(10) Patent No.: US 7,927,165 B2
(45) Date of Patent: Apr. 19, 2011

(54) PROCESS AND APPARATUS FOR MANUFACTURING A CONTAINER FOR ACCOMMODATING AN HG SOURCE FOR A DISCHARGE LAMP

(75) Inventor: Josef Schlecht, Pöttmes (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 345 days.

(21) Appl. No.: 12/219,470

(22) Filed: Jul. 23, 2008

(65) Prior Publication Data

US 2009/0029624 A1 Jan. 29, 2009

(30) Foreign Application Priority Data

Jul. 23, 2007 (DE) ..... 10 2007 034 227

(51) Int. Cl.
*H01J 9/20* (2006.01)

(52) U.S. Cl. ..... 445/22; 445/26; 445/27

(58) Field of Classification Search ..... 445/22, 445/23, 26, 27, 66
See application file for complete search history.

(56) References Cited

U.S. PATENT DOCUMENTS

| | | | | |
|---|---|---|---|---|
| 5,896,003 | A * | 4/1999 | Gehring | 445/26 |
| 5,913,705 | A * | 6/1999 | Kiesel | 445/27 |
| 6,517,404 | B1 * | 2/2003 | Lamouri et al. | 445/26 |
| 6,612,892 | B1 * | 9/2003 | Lamouri et al. | 445/26 |
| 6,685,525 | B1 * | 2/2004 | Maeda | 445/27 |
| 6,746,641 | B1 * | 6/2004 | Gunkel et al. | 264/464 |
| 2004/0214500 | A1 * | 10/2004 | Iida et al. | 445/22 |
| 2005/0136194 | A1 * | 6/2005 | Sedenszki et al. | 427/598 |
| 2006/0030232 | A1 * | 2/2006 | Fujiwara et al. | 445/26 |

* cited by examiner

*Primary Examiner* — Bumsuk Won

(57) ABSTRACT

A manufacturing process and apparatus used to produce a container which is capable of accommodate an Hg source for a discharge lamp. The manufacturing includes producing a helical cutout in a coil former, inserting a flexible strip-like wire fabric into the helical cutout, automatically producing a coiled hollow-cylindrical strand at an outlet of the coil former by means of the strip-shaped wire fabric being moved through the helical cutout, and producing a coiled hollow-cylindrical container from the strand.

18 Claims, 2 Drawing Sheets

PROCESS AND APPARATUS FOR MANUFACTURING A CONTAINER FOR ACCOMMODATING AN HG SOURCE FOR A DISCHARGE LAMP

TECHNICAL FIELD

The invention relates to a process and an apparatus for manufacturing a container for accommodating an Hg source for a discharge lamp.

PRIOR ART

For operation of discharge lamps it is necessary for mercury to be evaporated in the discharge space of the discharge lamp in order to be able to excite the Hg atoms and Hg ions in the discharge space in order to be able to induce UV radiation for inducing the phosphors which are contained in a fluorescent layer of the discharge vessel to emit light. The Hg source can be arranged in a container which is arranged in the discharge lamp.

DESCRIPTION OF THE INVENTION

It is an object of the present invention to provide a process and an apparatus with which the manufacture of a container for accommodating such an Hg source can take place with little complexity and at low cost.

This object is achieved by a process which has the features as claimed in claim 1 and an apparatus which has the features as claimed in claim 16.

In a process according to the invention for manufacturing a container for accommodating an Hg source for a discharge lamp, first a helical cutout is produced in a coil former. This coil former is used in particular as the basic element for manufacturing the container, with it being possible for this coil former to be used both in a fixed position and in mobile fashion.

A flexible, strip-like wire fabric is inserted into this helical cutout of the coil former. Furthermore, this strip-shaped wire fabric is moved through the helical cutout and, by means of this through-movement and the specific shape of the cutout, a coiled hollow-cylindrical strand is automatically produced, from which the container is formed.

As a result of the specific shape of the cutout and the through-movement of the strip-shaped wire fabric, a desired shape of the container is produced quasi automatically. This can therefore take place in a manner with very little complexity and at very low cost. Furthermore, the number of rejects can be substantially reduced since the shaping and the production of the outer surface of the container by means of the strip-shaped wire fabric can take place in a very precise and defined manner. It is possible to prevent the flexible fabric material from spreading, becoming stuck or knitting together.

Preferably, the helical cutout is designed to be tapered over its length in the coil former. It is particularly preferred if the helical cutout is designed to be in the form of a funnel, when viewed over its length. By means of such a configuration of the cutout, firstly, simple insertion of the flexible strip-like wire fabric at the inlet of the cutout and therefore corresponding dimensioning of the desired coiled hollow-cylindrical container on the other side of the coil former can automatically be achieved. At the outlet of the cutout, a coiled hollow-cylindrical container is therefore already produced which is provided with the corresponding diameter and the desired recoiling of the strip-like wire fabric. Since in particular also the recoiling of the wire fabric and therefore the action of laying the fabric over itself is essential for the stability and also the subsequent action of passing through the Hg material is essential during operation of the lamp, with this specific embodiment of the process these aspects can be taken into consideration particularly well.

Preferably, the helical cutout is produced so as to be continuous over the entire length of the coil former. This means that it is possible to achieve a situation in which the flexible strip-like wire fabric is supplied over one side of the coil former and is transported quasi through the coil former, the winding and configuration of the container thus being influenced and produced and the desired shape and dimensions of the shape of the hollow cylinder being achieved on the opposite side of the coil former in order then to be able to specifically separate a container.

Preferably, the coiled hollow-cylindrical container is passed out of the coil former at the outlet of the helical cutout. This automated process favors efficient and precise manufacture of the container as well.

Preferably, a partitioning apparatus is arranged at the outlet of the cutout and therefore at the end of the coil former and deforms, in particular compresses, the coiled hollow-cylindrical container at a predetermined length. In order to produce the desired defined container, the coiled hollow cylinder emerging from the cutout is therefore deformed at a specific length, which then corresponds to one end of the desired container. The compression or flattening can prevent materials which have been introduced into the hollow cylinder shape from falling out at this end and being inserted too far in an undesirable manner.

Preferably, a bore, which passes right through the coil former, is formed in the center of the helical path of the cutout. Via this bore an Hg-containing material, in particular amalgam, can preferably be introduced at the inlet of the cutout, and this material can then be passed via the bore through the coil former and guided into the coiled hollow-cylindrical container. In addition, an automatic filling apparatus is therefore also provided which makes it possible to introduce Hg-containing material, in particular amalgam spheres, via the coil former into the coiled hollow-cylindrical structure extending out of the coil former in a simple and reliable manner. Therefore not only simple manufacture of the container per se but furthermore also simple filling of this container can be enabled. The reliable and positionally accurate introduction of in particular the amalgam material can be ensured thereby and the introduction can therefore be integrated in the manufacturing process of the container.

An additional filling station or the like is no longer required.

Preferably, once the container has been filled with an Hg-containing material, the ends of the container are welded. For this purpose it is provided that the predetermined length of the container is defined and, in the case of the coiled hollow cylinder extending outward from the coil former, welding is carried out at the corresponding locations.

Preferably, once it has been filled with the Hg-containing material, the container which is predetermined by such a defined length is separated from the coiled hollow cylinder extending out of the coil former at the outlet. In particular, in this case it is cut away. Preferably, the container is also compressed.

The welding of the ends of the container preferably takes place by means of resistance welding.

It is preferably provided that the helical cutout is produced with a turns number of between 1.3 and 2, in particular with a turns number of 1.5. Such dimensioning of the helical cutout can always ensure that sufficient overlapping of the end regions of the strip-shaped wire fabric can be achieved and therefore the coiled hollow-cylindrical container produced can be prevented from becoming detached in an undesirable manner.

Preferably, the wire fabric is produced in the form of a fine-mesh fabric made from stainless steel. Firstly, the required flexibility in terms of the introduction into the helical cutout can thus be ensured and furthermore it is thereby also possible to achieve a situation in which the Hg-containing material emerges via this fine-mesh fabric during operation of the lamp.

Preferably, the container is manufactured with a length of between 3 mm and 6 mm.

It has proven to be particularly preferable if the helical cutout is produced in the coil former by means of being eroded into it. This specific procedure can mean that the helix is shaped very precisely into the coil former and furthermore it is possible for quick and inexpensive production of the cutout to be ensured.

It is preferably provided that, in order to insert and move the strip-shaped wire fabric through the helical cutout, an auxiliary element is fitted on the wire fabric, which auxiliary element is passed through the cutout. Particularly preferably, it is provided in this case that a wire is welded at the edge of the strip-shaped wire fabric strip, and this wire can then be passed through the helical cutout. It is preferably provided in this case that this auxiliary element is passed through the bore formed in the center of the helical cutout. However, it can also be provided that this auxiliary element is moved through at any other point on the helical cutout in order then to draw strip-shaped wire fabric after it and to achieve the coiled hollow-cylindrical shape.

An apparatus according to the invention for manufacturing a container for accommodating an Hg source for a discharge lamp has a coil former, in which a helical cutout is formed, into which a flexible strip-shaped wire fabric can be inserted and can be passed through the cutout so as to produce a coiled hollow-cylindrical container.

Preferably, the cutout has a continuous bore, through which Hg-containing material can be introduced into the coiled strand, which emerges at the outlet of the cutout, of the wire fabric.

Advantageous embodiments of the process according to the invention should also be regarded as being advantageous embodiments of the apparatus.

BRIEF DESCRIPTION OF THE DRAWINGS

An exemplary embodiment of the invention will be explained in more detail below with reference to schematic drawings, in which.

PREFERRED EMBODIMENT OF THE INVENTION

Identical or functionally identical elements have been provided with the same reference symbols in the figures.

Figure 1:
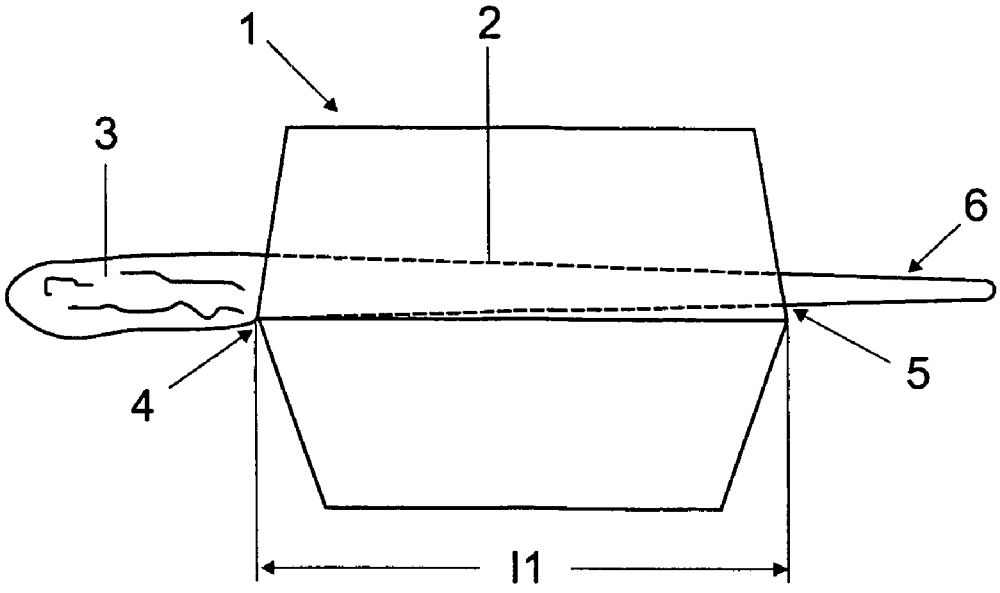
FIG. 1 shows a perspective illustration showing the manufacture of a container in a specific production step.

FIG. 1 shows a simplified, schematic side view of a coil former 1 which is in the form of a right parallelepiped. A helical cutout 2 is formed in the coil former 1, which is preferably formed from metal. This cutout is illustrated by dashed lines in FIG. 1 to provide a symbolic view, with this illustration showing that this helical cutout 2 extends over the entire length 11 of the coil former 1. As is indicated in FIG. 1, the helical cutout 2 is in the form of a funnel over its entire length 11 and is designed so as to be continuously tapered from an inlet 4 to an outlet 5.

FIG. 1 illustrates an apparatus in terms of the manufacture of a container 8 (FIG. 3) for accommodating an Hg source 9 for a discharge lamp, with the manufacture in one specific production step being shown.

In the manufacturing process for the container 8, first the abovementioned helical cutout 2 is produced in the coil former 1. In the exemplary embodiment this is carried out by means of it being eroded into the coil former 1. In a subsequent production step, a flexible strip-like wire fabric 3 is then inserted into the helical cutout 2 via the inlet 4. For this purpose, an auxiliary element (not illustrated) in form of an additional wire piece is welded at a front end (not illustrated) of the strip-shaped wire fabric 3. The wire piece can then be pushed through the helical cutout 2 and simply drawn out at the outlet 5. In the exemplary embodiment, the strip-shaped wire fabric 3 is in the form of a fine-mesh fabric made from stainless steel and can be wound up in the form of a strip onto a roller and unrolled from this roller in order to insert it into the helical cutout 2.

This wire fabric 3 is then automatically formed into a coil by means of the helical cutout when it is moved through this cutout 2 and emerges at the outlet 5 as a coiled hollow-cylindrical strand 6. This stage of the production of the container 8 is shown in FIG. 1 as a snapshot.

For further production of the coiled hollow-cylindrical container 8, the hose or strand 6 is deformed, in particular compressed or flattened, at a predetermined length once it has emerged from the outlet 5 by means of a partitioning apparatus (not illustrated), in particular a partitioning wheel.

Subsequently, amalgam spheres 9 (FIG. 3), which are used as Hg sources during operation of the discharge lamp, are then introduced. For this purpose, these amalgam spheres 9 are supplied via a continuous bore 7, which is located centrally in the helical cutout 2. In this case, these amalgam spheres 9 are inserted into the bore 7 at the inlet 4 and passed through the helical cutout 2 through the coil former 1 in order then to enter the strand 6. There, they can reach at most as far as the flattened or pinched end.

If the desired quantity of amalgam spheres 9 is contained in the separated part of the strand 6, welding of the end regions provided of the container 8 is then carried out, for this purpose in particular resistance welding being carried out.

Subsequently, cutting of the coiled hollow-cylindrical container 8 over its desired length 12 (FIG. 3) is then carried out. Subsequently, compression of the coiled hollow-cylindrical container 8 then also takes place.

It can also be provided that first the strand 6 is filled with amalgam spheres 9, then partitioning takes place at the desired locations by means of deformation of the strand 6, subsequently welding is carried out, subsequently the cutting for defined separation of the container 8 with the desired length 12 or bending back for the purpose of closing the container 8 is carried out.

Figure 2:
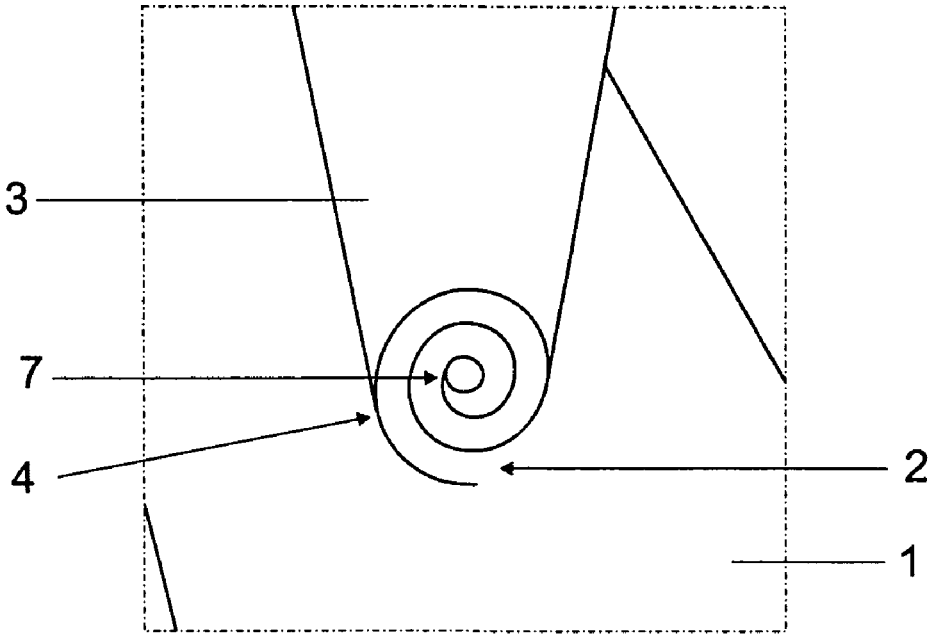
FIG. 2 shows a perspective view at the inlet of the helical cutout of the coil former.

FIG. 2 shows a perspective illustration in which the coil former 1 at the inlet 4 of the helical cutout 2 is shown. It can be seen that the bore 7 is formed centrally in the helical cutout and has a markedly larger diameter than the width of a coil in which the wire fabric 3 is inserted. Furthermore, FIG. 2 also shows that the helical cutout 2 is designed to have a turns number of at least 1.5.

Figure 3:
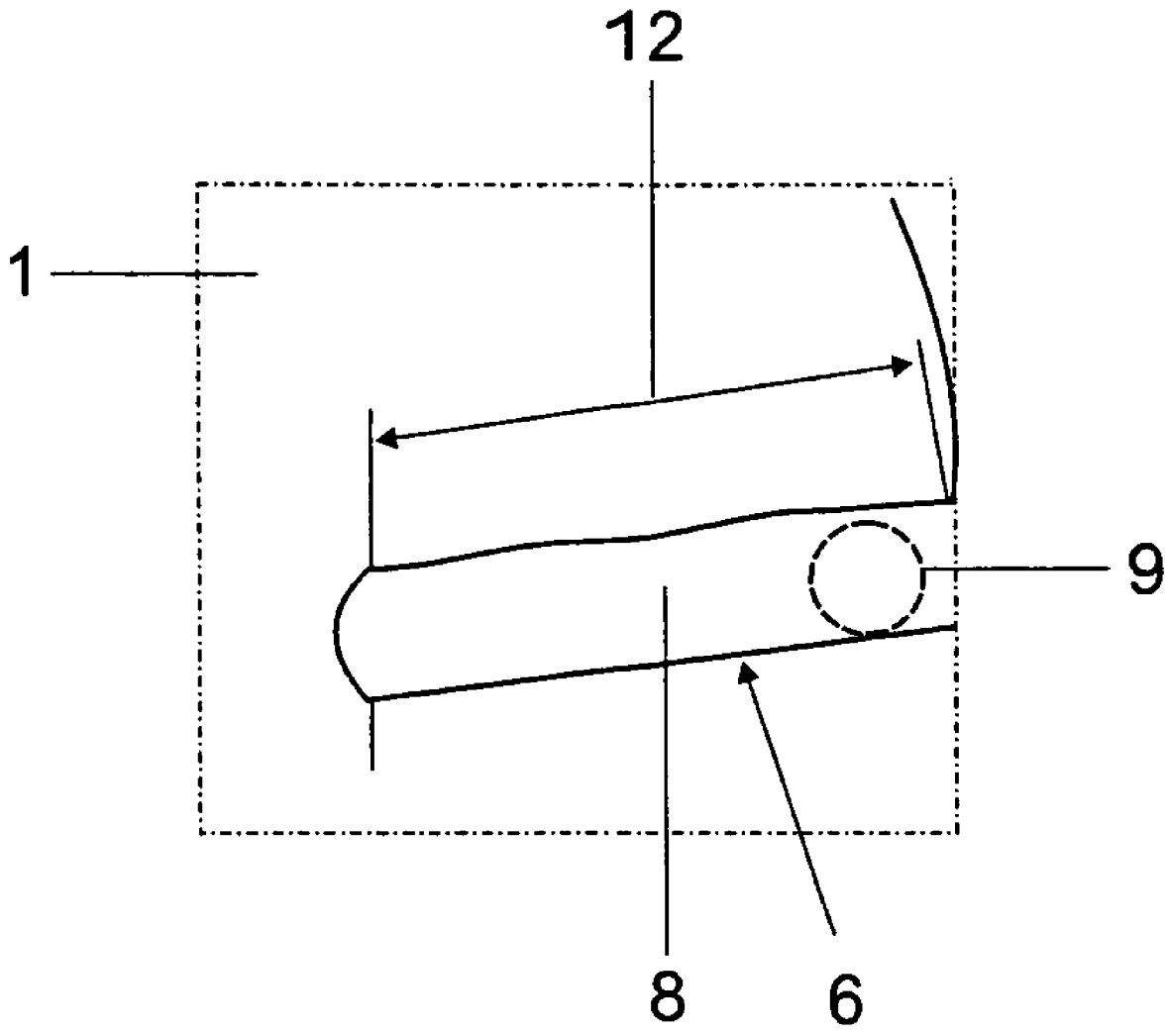
FIG. 3 shows a perspective illustration at the outlet of the helical cutout of the coil former.

FIG. 3 shows an enlarged perspective illustration at the outlet 5 of the helical cutout 2. The length 12 of the symbolically illustrated container 8 is shown schematically. In FIG. 3, this container 8 has not yet been separated from the strand 6, but an exemplary length 12 for such a container 8 is shown for improved comprehensibility. Furthermore, the figure shows symbolically and by way of example an amalgam sphere 9, which is contained in that part of the strand 6 which forms the container 8.

As shown in the illustrations in FIG. 2 and FIG. 3, the material of the wire fabric which is initially provided in the form of a foil, is uncoiled in a strip and supplied to the helical cutout 2 in substantially planar form and inserted there and a tubular structure in the form of the strand 6 is produced at the outlet 5 by means of the wire fabric 3 being made into a coil in the helical cutout 2. By means of the apparatus shown in FIG. 1, automatic production of the strand 6 with corresponding dimensioning of the diameter and a corresponding coil formation for stabilizing the wall of the tubular strand 6 is produced quasi by means of the movement of the wire fabric 3 through the cutout, and the container 8 with a desired specific length 12 can then be separated from this strand 6.

As a result of the helical shape of the cutout 2, when the wire fabric 3 is inserted and this wire fabric 3 is passed through as far as the outlet 5, the strip shape of the wire fabric 3 is prevented from becoming knitted together. Since, furthermore, longitudinal edges of the wire fabric 3 need to be brought one on top of the other, the funnel-shaped helical shape of the cutout 2 is particularly advantageous.

The invention claimed is:

1. A process for manufacturing a container (8) for accommodating an Hg source (9) for a discharge lamp, in which the following steps are carried out:

a) production of a helical cutout (2) in a coil former (1);

b) insertion of a flexible strip-like wire fabric (3) into the helical cutout (2);

c) automatic production of a coiled hollow-cylindrical strand (6) at an outlet of the coil former (1) by means of the strip-shaped wire fabric (3) being moved through the helical cutout (2); and d) production of a coiled hollow-cylindrical container (8) from the strand (6).

2. The process as claimed in claim 1, characterized in that the helical cutout (2) is designed to be tapered over its length (11).

3. The process as claimed in claim 2, characterized in that the helical cutout (2) is produced so as to be continuous over the entire length (11) of the coil former (1).

4. The process as claimed in claim 2, characterized in that the coiled hollow-cylindrical strand (6) is passed out of the coil former (1) at the outlet (5) of the helical cutout (2).

5. The process as claimed in claim 1, characterized in that the helical cutout (2) is produced so as to be continuous over the entire length (11) of the coil former (1).

6. The process as claimed in claim 1, characterized in that the coiled hollow-cylindrical strand (6) is passed out of the coil former (1) at the outlet (5) of the helical cutout (2).

7. The process as claimed in claim 6, characterized in that a partitioning apparatus is arranged at the outlet of the coil former (1) and deforms, in particular compresses, the strand (6) so as to form the coiled hollow-cylindrical container (8) at a predetermined length (12).

8. The process as claimed in claim 1, characterized in that a bore (7), which passes right through the coil former (1), is formed in the center of the helical path of the cutout (2).

9. The process as claimed in claim 8, characterized in that amalgam, in particular amalgam spheres (9), is introduced via the bore (7) at the inlet (4) of the cutout (2) and is guided via the bore (7) into the coiled hollow-cylindrical container (8).

10. The process as claimed in claim 1, characterized in that the coiled hollow-cylindrical container (8) is filled with an Hg-containing material.

11. The process as claimed in claim 10, characterized in that, once the container (8) has been filled, the ends of the container (8) are welded.

12. The process as claimed in claim 10, characterized in that, once it has been filled, the container (8) in its predetermined length (12) is separated, in particular cut away, from the strand (6) emerging at the outlet (5) from the cutout (2), and the container (8) is compressed.

13. The process as claimed in claim 10, characterized in that amalgam, in particular amalgam spheres (9), is introduced via the bore (7) at the inlet (4) of the cutout (2) and is guided via the bore (7) into the coiled hollow-cylindrical container (8).

14. The process as claimed in claim 1, characterized in that the helical cutout (2) is produced with a turns number of between 1.3 and 2, in particular 1.5.

15. The process as claimed in claim 1, characterized in that the wire fabric (3) is in the form of a fine-mesh fabric made from stainless steel.

16. The process as claimed in claim 1, characterized in that the container (8) is manufactured with a length (12) of between 3 mm and 6 mm.

17. The process as claimed in claim 1, characterized in that the helical cutout (2) is produced in the coil former (1) by means of being eroded into it.

18. The process as claimed in claim 1, characterized in that, in order to insert and move the strip-shaped wire fabric (3) through the helical cutout (2), an auxiliary element, in particular a wire, is fitted on the wire fabric (3), which auxiliary means is passed through the cutout (2).

* * * * *